US007338289B2

(12) United States Patent
Wu

(10) Patent No.: US 7,338,289 B2
(45) Date of Patent: Mar. 4, 2008

(54) ELECTRICAL CONNECTOR ASSEMBLY HAVING IMPROVED NECKLACE CABLE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/603,580

(22) Filed: Nov. 22, 2006

(65) Prior Publication Data

US 2007/0117452 A1 May 24, 2007

(30) Foreign Application Priority Data

Nov. 23, 2005 (CN) ..... 2005 2 0078036 U

(51) Int. Cl.
*H04R 25/00* (2006.01)

(52) U.S. Cl. ..... 439/37; 439/531

(58) Field of Classification Search ..... 439/531, 439/37

See application file for complete search history.

(56) References Cited

U.S. PATENT DOCUMENTS

| | | | | |
|---|---|---|---|---|
| 6,171,136 | B1 | 1/2001 | Liu et al. | |
| 6,626,009 | B1 * | 9/2003 | Ohlund | 63/3.1 |
| 2001/0027089 | A1 * | 10/2001 | Salam | 455/90 |
| 2002/0181729 | A1 * | 12/2002 | Smith | 381/381 |

FOREIGN PATENT DOCUMENTS

| | | |
|---|---|---|
| CN | 93224221.9 | 6/1994 |

* cited by examiner

*Primary Examiner*—Gary Paumen
(74) *Attorney, Agent, or Firm*—Wei Te Chung

(57) ABSTRACT

An electrical connector assembly (100) includes a body portion defining a receiving space, a connector (200) assembled into the receiving space, a necklace cable (7') attached to the body portion, an earpiece (73) with a connecting cable (7) electrically attached to the connector. The connecting cable is coaxial with the necklace cable which is attached with the body portion directing the connecting cable toward the connector.

19 Claims, 8 Drawing Sheets

ELECTRICAL CONNECTOR ASSEMBLY HAVING IMPROVED NECKLACE CABLE

BACKGROUND OF THE INVENTION

1. Field of the Invention

The present invention relates generally to an electrical connector assembly, and more particularly to an electrical connector assembly for transmitting an audio signal.

2. Description of Related Arts

In recent years, personal mobile communication and audio devices including MP3 player are increased in use for communication, playing. Especially, MP3 players, featured of various functions, a good sound quality similar to that of compact discs and a compact structure, are favored by consumers. In general, a MP3 player is constituted with a main portion, and an earpiece with a connecting cable electrically connecting to the main portion for listening to the music played by the main portion. For the convenience of enjoying the music in a sportive circumstance, a necklace hung on a user's neck has been added. However, a problem that the necklace often twists with the connecting cable is raised simultaneously.

A China Pat. No. 93224221.9 ("the '221 patent") which issued on Jun. 15, 1994 provides a solution to above problem. The '221 patent, in conjunction with the specification and figures, shows a radio for listening to a wireless signal comprising an earpiece with a connecting cable for electrically connecting the earpiece to the radio, a necklace cable with a hollow channel extending therein for allowing the connecting cable partially received therein. This solution of the '221 patent effectively prevents the necklace cable from twisting with the connecting cable.

However, the '221 patent incidentally put forward a new problem. Referring to FIG. 2 of the '221 patent, the connecting cable and the necklace cable connect with corresponding elements of the radio respectively to achieve reliable mechanical and electrical connections. However, these connections are not as reliable as we expected, and are easily suffered from a user's unintentional drag, thereby needlessly breaking above electrical connections and influencing audio signal transmission.

Hence, an electrical connector assembly having improved necklace cable is desired.

SUMMARY OF THE INVENTION

Accordingly, the object of the present invention is to provide an electrical connector assembly for assuring a reliable connection.

Another object of the present invention is to provide an electrical connector assembly having improved necklace cable for preventing cable from twisting.

To achieve the above objects, an electrical connector assembly in according with the present invention comprises a body portion defining a receiving space, a connector assembled into the receiving space, a necklace cable attached to the body portion, an earpiece with a connecting cable electrically attached to the connector, wherein the connecting cable is coaxial with the necklace cable which is integral with the body portion directing the connecting cable toward the connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
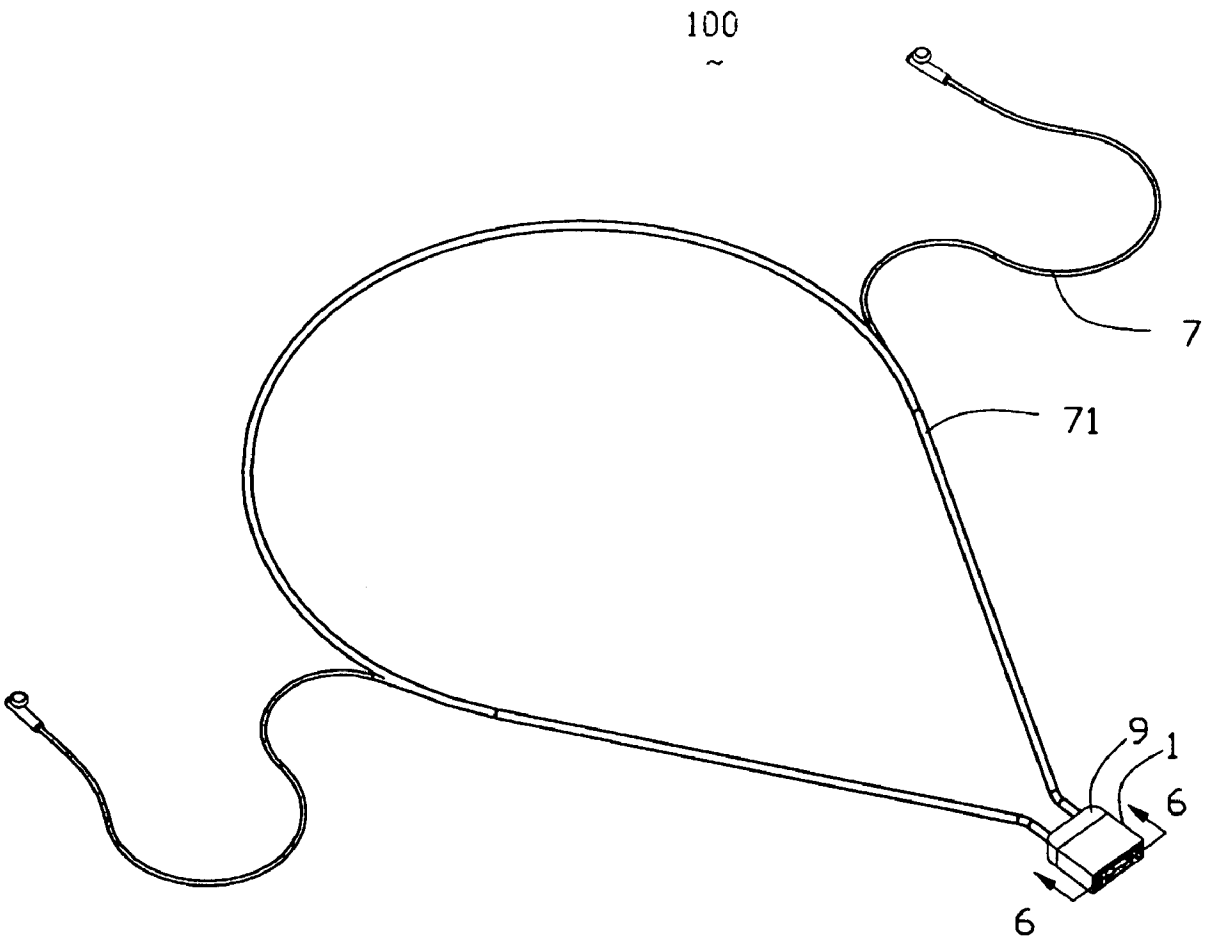
FIG. 1 is a perspective, assembled view of an electrical connector assembly in accordance with the present invention.

Referring to FIGS. 1-6, an electrical connector assembly 100 in accordance with the present invention comprises a body portion (not labeled), a connector 200 assembled into the body portion, a necklace cable 7' attached to the body portion, a pair of earpieces 73 with a connecting cable 7 electrically attached to the connector 200, a casing 8 partially enclosing the rear end of the connector 200 and the front end of cable 700 which is composed of the necklace cable 7' and the connecting cable 7. The body portion comprises a first shielding member 1, and a second shielding member 9 attached to the first shielding member 1, which together defining a receiving space (not labeled) for receiving the connector 200 and the casing 8 therein. The connector 200, particularly referring to FIG. 5, comprises a shielding cover 2, an insulative housing 3 received in the shielding cover 2, a plurality of first and second contacts 4, 5 received in the insulative housing 3 and electrically attached with the cable 700, and a spacer 6 attached to the insulative housing 3 for supporting the first and second contacts 4, 5.

Figure 2:
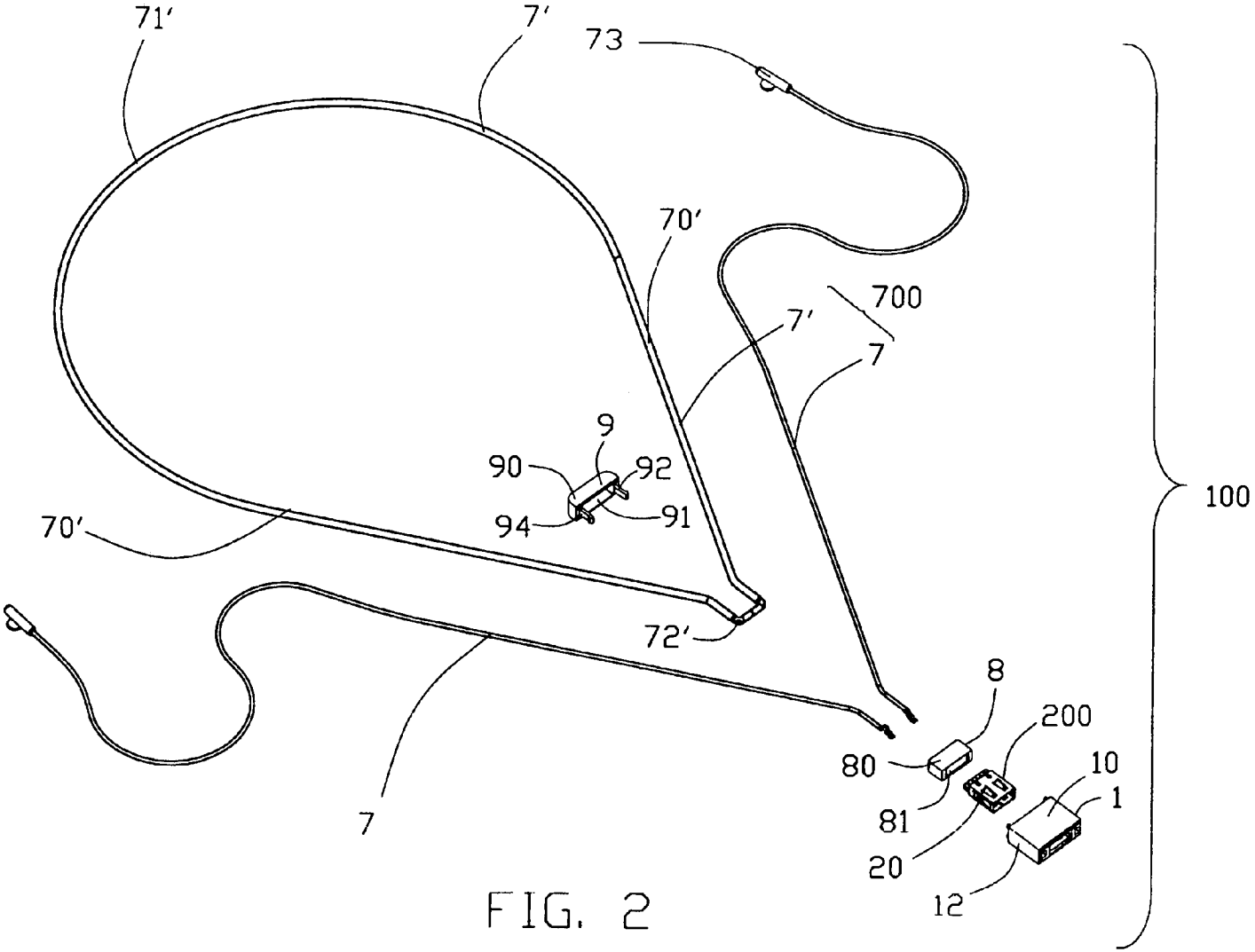
FIG. 2 is an partially perspective, exploded view of the electrical connector assembly of FIG. 1.
Figure 3:
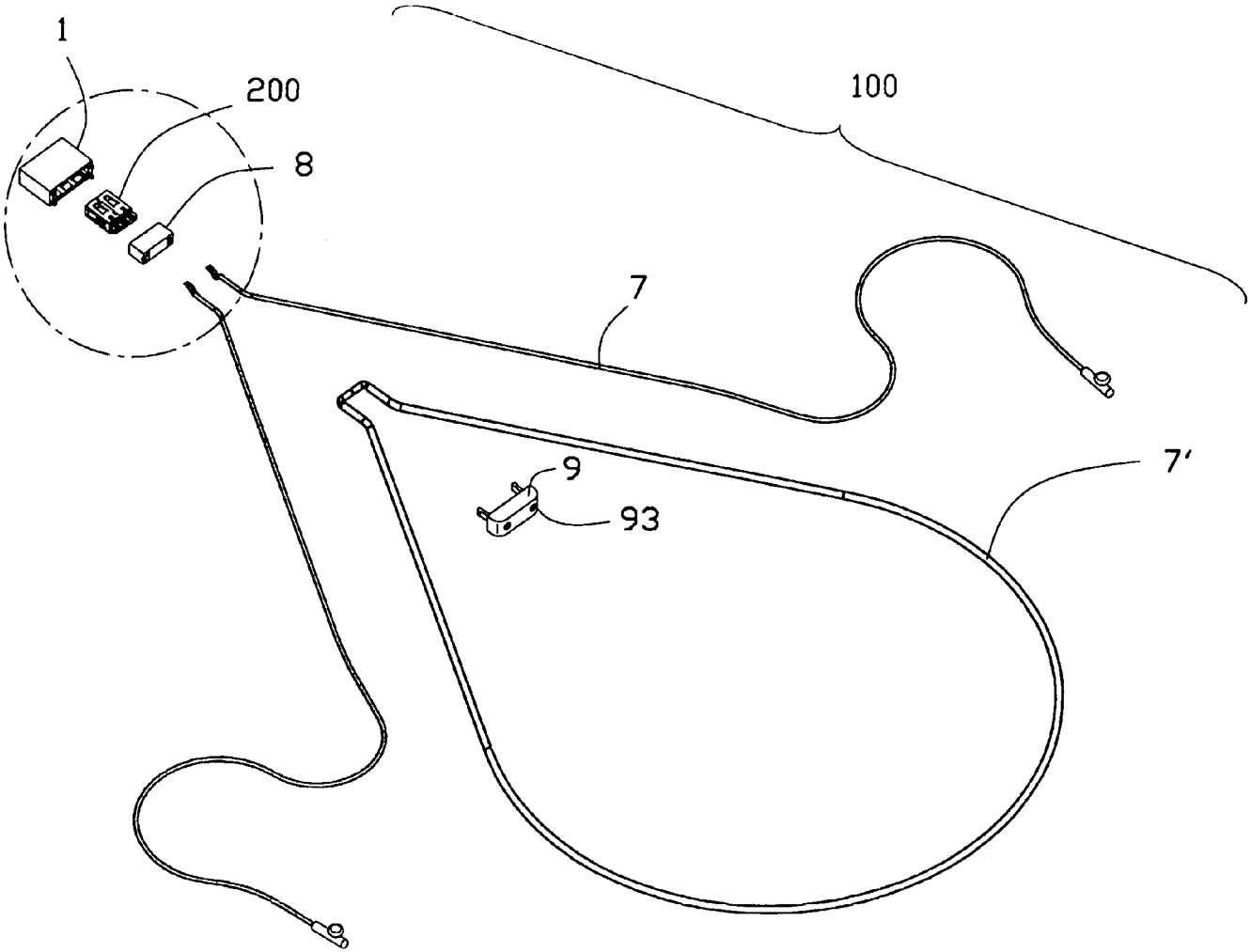
FIG. 3 is a view similar to FIG. 2, but taken from a different aspect.
Figure 4:
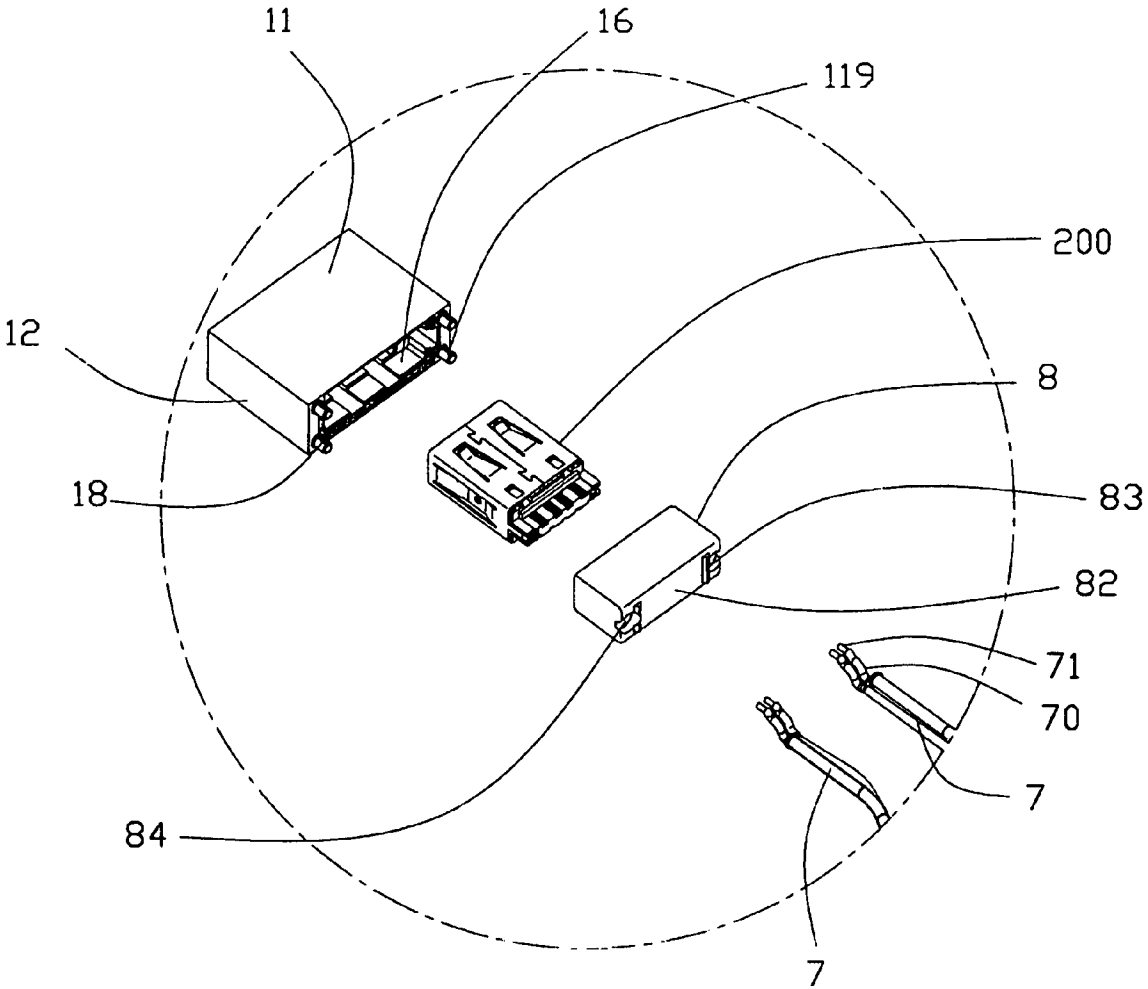
FIG. 4 is an enlarged view taken from a circled portion of FIG. 3.
Figure 7:
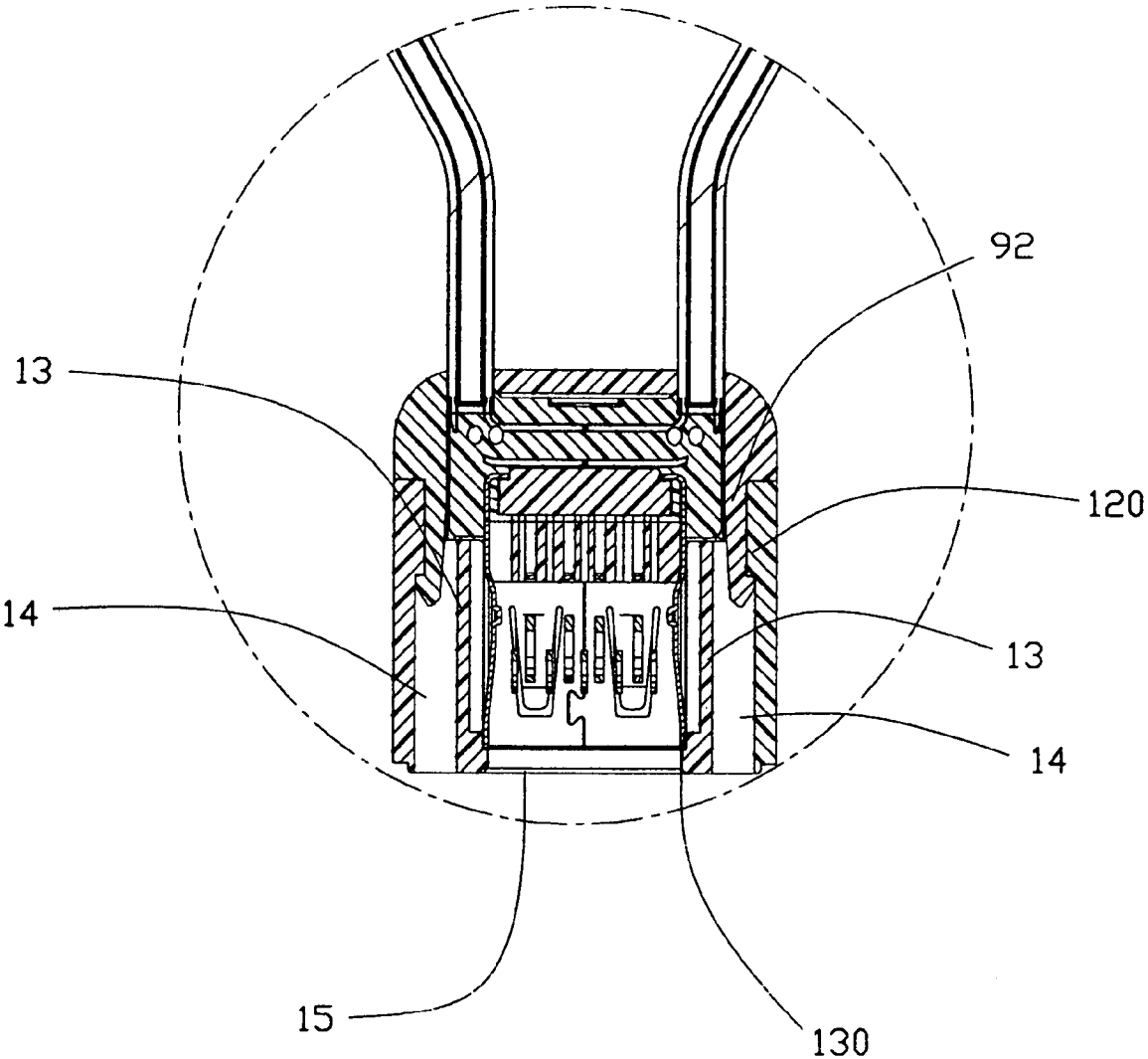
FIGS. 7-8 are enlarged views taken from circled portions of FIG. 6.
Figure 8:
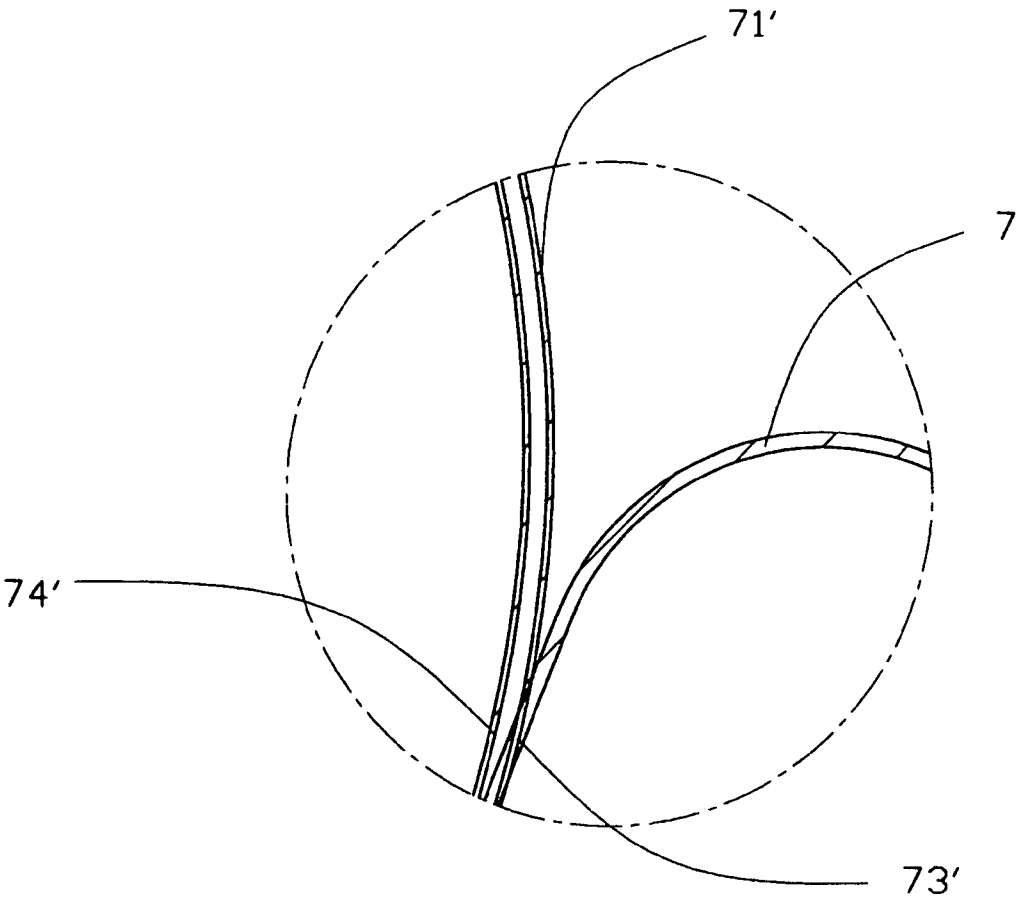

Referring to FIGS. 2-4 in conjunction with FIG. 7, The first shielding member 1 with a substantially rectangular configuration, comprises a first top surface 10, a first bottom surface 11 opposite to the first top surface 10, and a pair of opposite lateral walls 12 integrally connected with the first top and bottom walls 10, 11. These walls together define a receiving cavity (not labeled) for receiving the connector 200 therein. A pair of first inner walls 13 parallel to opposite lateral walls 12 is disposed in the receiving cavity for partitioning the receiving cavity into a first cavity 15, a second cavity 16 communicating with the first cavity 15, and a pair of first channels 14 respectively formed between the first inner walls 13 and the first lateral walls 12. A pair of locking portions 120 with a ladder configuration is respectively formed on the inner surfaces of the first lateral walls 12. A pair of restrictive portions 130 with a ladder configuration is respectively formed on the inner surfaces of the first inner walls 13 and adjacent to a front end of the first shielding member 1. A number of column-shape posts 18 with a plurality of ribs 119 formed on each post 18 extend rearwardly from a rear end opposite to above front end of the first shielding member 1.

Referring to FIGS. 2-3, the second shielding member 9 comprises a main portion 90, and a pair of locking members 92 with a substantially fishhook-shaped configuration extending forwardly from the main portion 90. The main portion 90 defines a third cavity 91 communicating with the second cavity 16, a plurality of circular recesses 94 respectively depressed from a surface thereof and aligning with corresponding posts 18 of the first shielding member 1, and a pair of cable channels 93 depressed from another surface opposite to above surface thereof and communicating with the cavity 91 for allowing the cable 7 extending therethrough. In present embodiment, the receiving cavity of the first shielding member 1 and the third cavity 91 of the second shielding member 9 are collectively regarded as the receiving space for allowing the connector 200 and the casing 8 received in.

Figure 5:
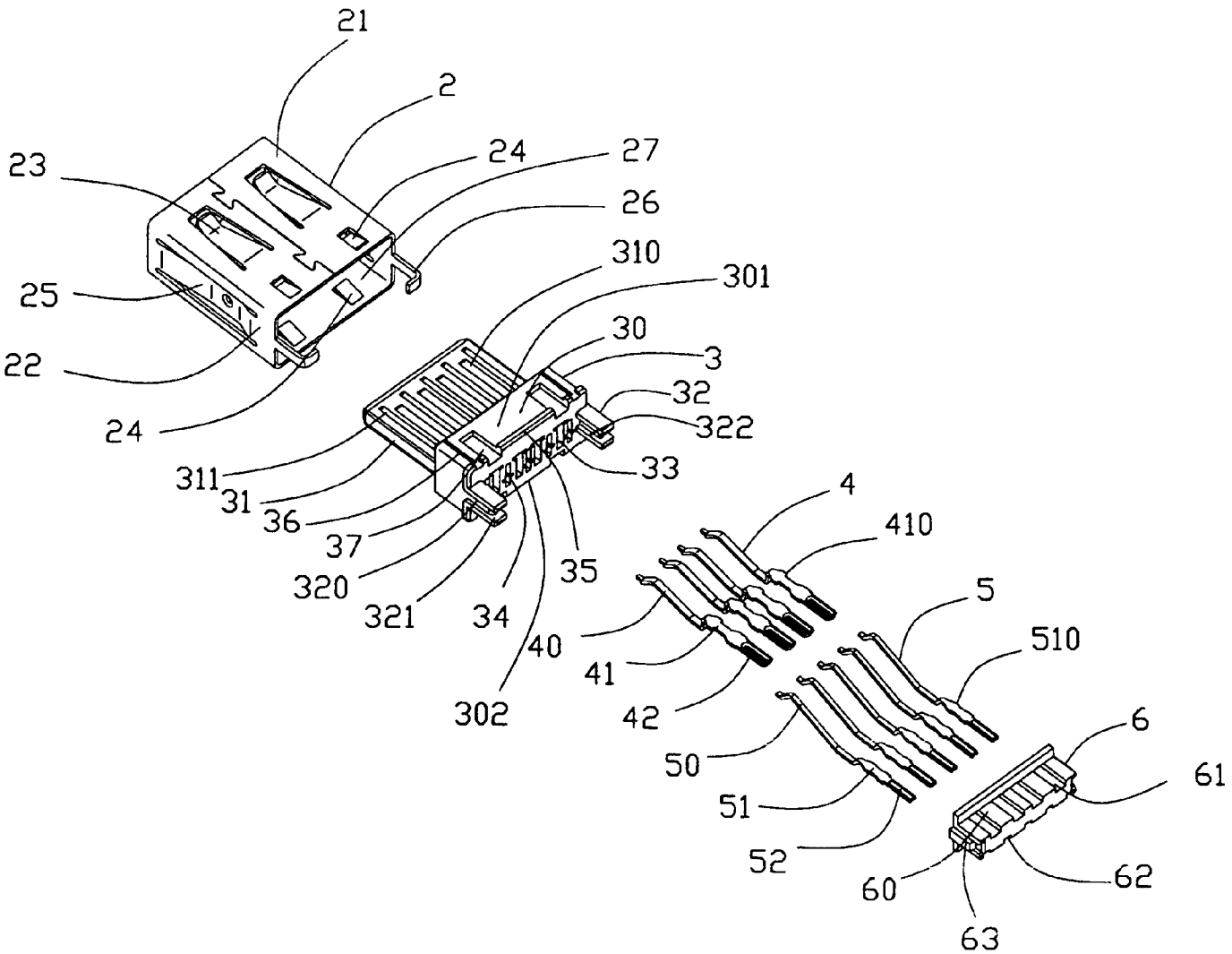
FIG. 5 is a perspective, exploded view of a connector of the electrical connector assembly in accordance with the present invention.

Referring to FIG. 2 in conjunction with FIG. 5, the shielding cover 2 is generally stamped from a piece of metal or other conductive materials. The shielding cover 2 is in an elongate frame shape for substantially shielding the insulative housing 3. The shielding member 2 comprises a second top wall 20, a second bottom wall 21 opposite to the second top wall 20, and a pair of second lateral walls 22 connecting with the second top and bottom walls 20, 21. These walls together define an opening 27 for receiving the insulative housing 3 therein. The second top and bottom walls 20, 21 respectively form a pair of first resilient pieces 23 protruding inwardly therefrom for electrically engaging with a corresponding element of complementary connector (not shown) when the electrical connector assembly 100 is assembled with the complementary connector, and a pair of second resilient pieces 24 aligning with corresponding first resilient pieces 23 in a rear-to-front direction. Each second lateral wall 22 forms a pair of third resilient pieces 25 protruding inwardly therefrom for fixing the electrical connector assembly 100 with the complementary connector reliably, and a pair of locking barbs 26 respectively extending rearwardly therefrom for locking with the insulative housing 3 and the spacer 6. Attentively, before an assembly process, the locking barb 26 is an l-shaped configuration. During the assembly process, the locking barb 26 will be bended from an l-shaped configuration into an L-shaped configuration for fastening the insulative housing 3 and the spacer 6 with the shielding cover 2. Certainly, a person of ordinary skill in this art can easily replace the locking barb 26 with a locking barb of another shape, for example, of a fishhook-shaped.

Referring to FIGS. 4-5, the insulative housing 3 comprises a base 30, a tongue 31 extending forwardly from the base 30, and a pair of stretching portions 32 extending rearwardly from two lateral sides of the base 30. The base 30 further comprises a plurality of first contact passageways 33 and a plurality of second contact passageways 34 arranged alternately with the first contact passageways 33, for allowing the first contacts 4 and the second contacts 5 extending therethrough. The base 30 also defines a pair of locking slots 37 respectively disposed on the top and bottom surfaces 302, 301 and extending inwardly therefrom for allowing the second resilient pieces 24 engaging with, a baffle 35 respectively disposed on the rear edges of top and bottom surfaces 302, 301 and extending outwardly therefrom, and a pair of protrudes 36 disposed on two lateral edges of top and bottom surfaces 302, 301 for interferentially engaged with corresponding inner surfaces of the shielding cover 2. The tongue 31 with a flat board configuration, comprises a plurality of first contact slots 310 aligning with the first contact passageways 32 and a plurality of second contact slots 311 respectively aligning with the second contact passageways 34 and arranged alternately with the first contact slots 310 respectively for respectively allowing the first and second contacts 4, 5 positioned therein. Each stretching portion 32 comprises a restricted slit 320 recessed inwardly from the outer wall thereof for allowing the locking barb 26 extending therethrough, a guiding slit 322 disposed in the inner wall thereof for guiding the spacer 6 to insert in, and a locking slit 321 communicating with the restricted slit 320 and the guiding slit 322 and provided for the locking barb 26 locking with.

Referring to FIG. 5, each first contact 4 comprises a first mating end 40 for electrically mating with corresponding contact of the complementary connector, a first tail end 42 for electrically connecting to the connecting cable 7 and a first retention portion 41 connected with the first mating end 40 and the first tail end 42. Each first retention portion 41 defines a plurality of first stings 410 disposed on two sides thereof for providing a retention function. Attentively, in present embodiment, the arrangement and distance of every two adjacent first contact 4 accords with a standard reference introduced in USB protocol. Obviously, the distance of every two adjacent first contact 4 may be varified more or less according to the standard reference introduced in USB protocol by a person with an ordinary skill in this art, based on this specification.

Referring to FIG. 5, each second contact 5 comprises a second mating end 50 for electrically mated with corresponding contact of complementary connector, a second tail end 52 for electrically connected to the cable 7 and a second retention portion 51 connected with the first mating end 50 and the first tail end 52. Each first retention portion 51 defines a plurality of second stings 510 disposed on two sides thereof for provided a retention function.

Referring to FIG. 5, the spacer 6 with a T-shaped structure comprises a base 60. The base 60 defines a plurality of first contact channels 61 recessed from one surface thereof for allowing corresponding first tail ends 42 of the first contacts 4 received therein, a plurality of second contact channels 62 recessed from the other surface thereof for allowing corresponding second tail ends 52 of the second contacts 5 received therein, and a pair of flanges 63 disposed at two sides thereof and respectively received in corresponding guiding slits 332 for providing a reliable connection therebetween.

Referring to FIGS. 2-8, the cable 700 comprises a pair of connecting cables 7 with a pair of earpieces 73 respectively attached thereto, and a necklace cable 7'.

The connecting cable 7 comprises a plurality of conductors 71 for transmitting audio signal and an insulative jacket 72 surrounding the conductors 71 for providing sheath.

The necklace cable 7' comprises a pair of first strings 70', a second string 71' integrally molded with the first strings 70'. Each first string 70' comprises a first aperture 72' formed on one end thereof, and a second aperture 73' formed on the other end thereof, and a cable chan aperture 72' and the second aperture 73' with a size of the diameter larger than that of the connecting cable 7. Noticeably, before an assembly process, the pair of first stings 70' are separated from each other rather than connected with each other shown in FIG. 3.

Referring to FIG. 2 in conjunction with FIG. 5, the casing 8 with a generally rectangular configuration comprises a base portion 80. The base portion 80 defines an opening 81 for partially enclosing the rear end of the connector 200 and the front end of the cable 7, and a pair of cable passageways 84 formed on a rear surface thereof and communicating with the opening 81 for allowing opposite ends of the cable 7 extending therethrough, and a plurality of bars 83 protruding from the rear surface 82 for providing friction.

In assembly, referring to FIGS. 1-8, the first and second contacts 4, 5 are firstly and respectively inserted in corresponding first and second contact receiving passageways 32, 34 of the insulative housing 3 until the first and second mating ends 40, 50 are respectively received in corresponding first and second contact slots 310, 311, with the first and second stings 410, 510 of the first and second retention portions 41, 51 interferentially abutting with the inner walls of the first and second contact receiving passageways 32, 34 for provided a reliable orientation therebetween. Then, the spacer 6 is pushed and engaged with the insulative housing 3, with the first and second tail ends 42, 52 of the contacts 4, 5 received in corresponding contact channels 61, 62 of the spacer 6 and the flanges 63 respectively received in corresponding guiding slots 322 of the insulative housing 3 for securing them reliably. Obviously, the spacer 6 seals the first and second contact receiving passageways 32, 34 and efficiently prevents the melting plastic material of the casing 8 in a later molding process from entering into the first and second contact receiving passageways 32, 34 and influencing the electrical connection between the electrical connector assembly 100 and the complementary connector.

Subsequently, above assembly is pushed and received into the shielding cover 2, with the base 30 and the tongue 31 are together received in the opening 27 until the baffle 35 of the insulative housing 3 abutting against the shielding cover 2 for avoiding an excessive insertion. In addition, during insertion process, the second resilient pieces 24 of the shielding member 2 respectively engage with corresponding locking slots 37 for preventing the insulative housing 3 from moving rearwardly, the protrudes 36 of the insulative housing 3 are tightly abutting against the inner surfaces of the shielding cover 2 for providing a reliable connection therebetween. The locking barbs 26 respectively slide along corresponding restricted slits 330, and bent inwardly to lock with the locking slits 330 and the rear end of the flanges 63 of the spacer 6 after the insulative housing 3 abuts against the shielding cover 2 for fastening these three elements together.

Figure 6:
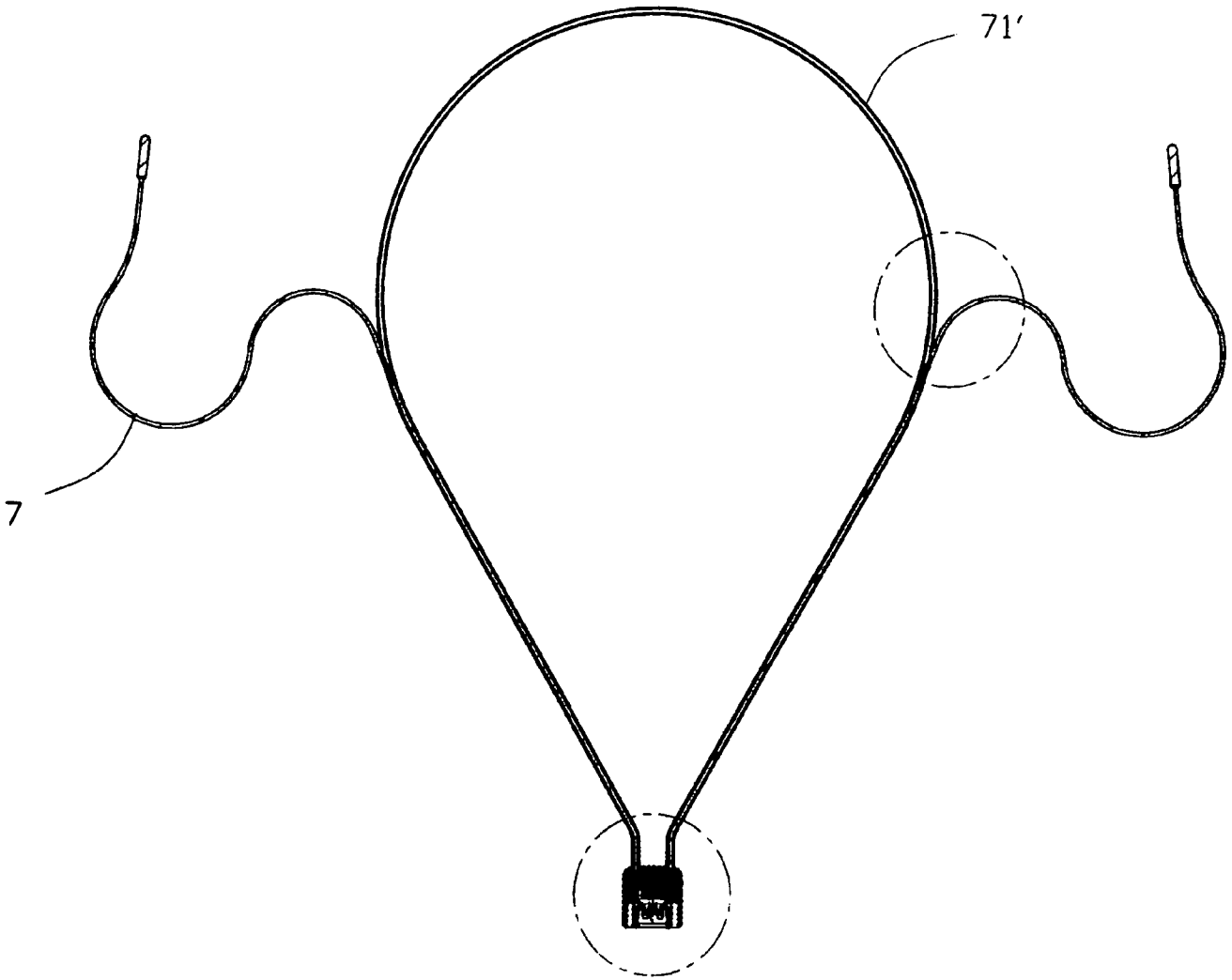
FIG. 6 is a cross sectional view of the electrical connector assembly of FIG. 1 taken along line 6-6 of FIG. 1.

Then, referring to FIGS. 6-7, the connecting cable 7 is inserted into the second aperture 73' of the necklace cable 7' and extends through the cable channel 74' until the conductors 71 penetrate the first aperture 72' and are exposed to outside. Obviously, the connecting cable 7 is partially coaxial with the necklace cable 7' for preventing these two cables twisting with each other. Then, inserting the above combination of connection cable 7 and the necklace cable 7' into the cable channels 93 and making them passing through the third cavity 91 of the second shielding member 9.

The conductors 71 of the connecting cable 7 are respectively soldered to the contacts, either the first contacts 4 or the second contacts 5, even all of the first and second contacts 4, 5. The first contact 4 is used to transmit a first signal, dissimilarly, some second contacts 5 are used to transmit a second signal, such as audio signal, and the remaining second contacts 5 are used to transmit other signals according to the advanced purpose. In view of the above explanation, according to the advanced purpose, the cable 7 is soldered to either the first tail ends 42 of first contacts 4 or the second tail ends 52 of second contacts 5 selectively. In this embodiment, the electrical connector assembly 100 is supposed to transmit a second signal. So, the conductors 71 of cable 7 should respectively connect with the second tail ends 52 of the first contact 5.

Subsequently, molding the casing 8. The casing 8 is designed to envelop the rear end of the connector 200, the joints between the contacts and the connecting cable 7, and the front end of the necklace cable 7' for directing the connecting cable 7 toward the connector 200, thereby providing a reliable connection therebetween.

Then, inserting above assembly into the first shielding member 1. The connector 200, and the casing 8 are respectively received in the first cavity 15 and the second cavity 16 until the shielding cover 2 abuts against the restrictive portions 130 for preventing the connector 200 from inserting excessively. It is noted that, a rear part of the casing 8 is exposed beyond the first rear surface of the first shielding member 1.

Lastly, assembling the shielding member 9 with the first shielding member 1. Because the connecting cable 7 and the necklace cable 7' has been inserted into the cable channels 93 and the third cavity 91 in above process, the shielding member 9 can slide across the cable 700 and lock with the first shielding member 1 for enclosing the exposed casing 8, with the locking members 92 respectively sliding along the first channels 14 until the locking members 92 lock with corresponding locking portions 120 so as to secure the first shielding member 1 and the second shielding member 9 together. In addition, the posts 18 of the first shielding member 1 are respectively received in corresponding recesses 94 of the shielding member 9 with the ribs 119 abutting against the inner surface of the recesses 96 for providing alternative way to secure the first shielding member 1 and the second shielding member 9 together. After assembly, the bars 83 of casing 8 abut against the shielding member 9 for providing a retention function therebetween. In this embodiment, the locking members 92 and the locking portions 120, which functioned as a locking mechanism, provide a retention connection between the first and second shielding members 1, 9. Similarly, the posts 119 and the recesses 94 can function as a locking mechanism. In this embodiment, the body portion, comprising the first shielding member 1 and second shielding member 9, is two-piece shape, a person with ordinary skill in this art can alternatively replace above two-pieces with a one-piece shape of the body portion. Obviously, the casing 8 also can be regarded as a part of the body portion and molded integrally for providing a space allowing the connector received therein and attaching the necklace cable 7' to the body portion reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a body portion defining a receiving space;

a connector assembled into the receiving space;

a necklace cable attached to the body portion;

an earpiece with a connecting cable electrically attached to the connector;

wherein the connecting cable is coaxial with the necklace cable which is attached with the body portion directing the connecting cable toward the connector.

2. The electrical connector assembly as described in claim 1, wherein the body portion is a two-piece shape, comprises a first shielding member and a second shielding member locking with the first shielding member for receiving the connector therein.

3. The electrical connector assembly as described in claim 2, wherein the body portion further comprises a casing for connecting the necklace cable with the body portion reliably.

4. The electrical connector assembly as described in claim 3, wherein the casing is integrally formed with the either the first shielding member or the second shielding member and encloses the connector and the front end of the necklace cable and the connecting cable.

5. The electrical connector assembly as described in claim 4, wherein the first shielding member and the second shielding member together comprises a locking mechanism for locking the first shielding member and the second shielding member reliably.

6. The electrical connector assembly as described in claim 5, wherein the locking mechanism is composed of a locking member formed on one of the first shielding member and second shielding member, a locking portion formed on the other of the first shielding member and the second shielding member, for assembling the first shielding member and the second shielding member together.

7. The electrical connector assembly as described in claim 6, wherein the connector comprises a shielding cover, an insulative housing received in the shielding cover, a plurality of contacts received in the insulative housing and electrically attached with the connecting cable, and a spacer attached to the insualtive housing.

8. The electrical connector assembly as described in claim 7, wherein the shielding cover comprises a first resilient piece disposed on one surface thereof and extending inwardly thereof for abutting against the complementary connector.

9. The electrical connector assembly as described in claim 8, the shielding cover comprises a second resilient piece disposed on another surface perpendicular to above surface and extending inwardly thereof for abutting against the complementary connector.

10. The electrical connector assembly as described in claim 9, wherein the shielding cover comprises a locking member for locking the shielding cover, the insulative housing and the spacer together.

11. The electrical connector assembly as described in claim 1, wherein the necklace cable defines a first aperture, a second aperture, and a cable channel formed between the first aperture and the second aperture for allowing a part of the connecting cable extending therethrough.

12. The electrical connector assembly as described in claim 11, wherein the electrical connector assembly further comprises a casing received in the body portion for molding with the front end of the necklace cable.

13. The electrical connector assembly as described in claim 12, wherein the connecting cable comprises a plurality of conductors partially exposed to outside of the necklace cable for electrically connecting with corresponding contacts received in the connector.

14. The electrical connector assembly as described in claim 13, wherein the first shielding member defines a restrictive portion for preventing the connector to be inserted excessively.

15. The electrical connector assembly as described in claim 13, wherein the contacts comprises a plurality of first contacts and a plurality of second contacts, the cable is soldered to either the first contacts or second contacts selectively for transmitting different signals according to distinct purposes.

16. An electrical connector assembly comprising:

a body portion defining a receiving space;

a connector assembled into the receiving space with a plurality of contacts received therein;

a necklace cable attached to the body portion with a cable channel formed therein; and a connecting cable with a plurality of conductors disposed therein extending through the cable channel of the necklace cable and electrically connecting with the contacts.

17. The electrical connector assembly as described in claim 16, wherein the body portion comprises a first shielding member, and a second shielding member connecting with the first shielding member to form the above receiving space.

18. The electrical connector assembly as described in claim 17, wherein the electrical connector assembly comprises a casing integrally molded with the necklace cable.

19. An electrical connector assembly, comprising:

a body portion defining a receiving space;

a connector assembled into the receiving space;

a necklace like piece having two opposite ends laterally spaced from each other with a distance and respectively connected to the body portion;

an earpiece with a pair of connecting cables having two opposite lower ends laterally spaced from each other with another distance and electrically attached to the connector; wherein each of the connecting cables has a lower portion intimately and supportably extending along the necklace like piece from the corresponding lower end with a length, and an upper portion leaving from the necklace like piece; wherein a head of the corresponding earpiece is positioned at an upper end of each of said connecting cables.

* * * * *